US005249617A

United States Patent [19]

Dürig

[11] Patent Number: 5,249,617

[45] Date of Patent: Oct. 5, 1993

[54] LOUVER CURTAIN

[75] Inventor: Heinz Dürig, Ostermundigen, Switzerland

[73] Assignee: K. Bratschi, Silent Gliss, Muri, Switzerland

[21] Appl. No.: 947,715

[22] Filed: Sep. 18, 1992

[30] Foreign Application Priority Data

Jan. 24, 1991 [CH] Switzerland ..... 205/91

[51] Int. Cl.[5] ..... E06B 9/36

[52] U.S. Cl. ..... 160/168.1; 160/176.1; 160/900

[58] Field of Search ..... 160/168.1, 176.1, 178.1, 160/900, 174, 177

[56] References Cited

U.S. PATENT DOCUMENTS

| | | | |
|---|---|---|---|
| 2,605,825 | 8/1952 | Armstrong | 160/900 X |
| 3,299,943 | 1/1967 | Poe | 160/900 X |
| 3,500,896 | 3/1970 | Endou | 160/178.1 X |
| 4,102,381 | 7/1978 | Bratschi | 160/900 X |
| 4,425,955 | 1/1984 | Kaucic | 160/168.1 |
| 4,552,195 | 11/1985 | Durig et al. | 160/900 X |
| 4,683,935 | 8/1987 | Arquati | 160/168.1 X |

FOREIGN PATENT DOCUMENTS

| | | |
|---|---|---|
| 081465 | 6/1983 | European Pat. Off. . |
| 349998 | 1/1990 | European Pat. Off. . |
| 2729491 | 2/1978 | Fed. Rep. of Germany . |

*Primary Examiner*—Blair M. Johnson
*Attorney, Agent, or Firm*—Morgan & Finnegan

[57] ABSTRACT

The louver curtain has a plurality of sliding elements (3) displaceably guided in a curtain rail (1). For displacing and swivelling the curtain louvers (4), the sliding elements each have a worm drive with a toothed gear (31). The toothed gears (31) mate with a sprocket chain (2) guided in the curtain rail (1). Preferably, the sprocket chain is a bridged-string chain, in which the bridges (24) have teeth (21) arranged on a broadside and projecting laterally, said teeth mating with the toothed gears (31). The bridges (21) are injected by injection molding onto flexible stranded steel cords (23). The louver curtain is motorizable and characterized by noiseless function combined with little friction.

10 Claims, 4 Drawing Sheets

LOUVER CURTAIN

A louver curtain of this type is known from DE-C-27 29 491 of the applicant. Said louver curtain has as the driving element a flexible, nonexpansible apertured belt, which is interlocked to form an endless train, and guided at both ends of the rail of the curtain via reversing pulleys. The curtain louvers can be swivelled and displaced with said apertured belt even when the rails of the curtain are bent. Motorizing is simple, technically speaking. The strand of the apertured belt combing with the toothed gears is guided in an inner and the returning strand in an outer of, in each case, two belt guides extending on both sides of the plane of the curtain in the curtain rail along the latter. With a two-part embodiment with two groups of curtain louvers that are displaceable against one another, two points of overlap are required in the driving element. The effect of said points of overlap is that when the curtain is closed, the two first sliders disposed opposite one another of the two parts of the system cannot fall short of a certain spacing. In this way, the width of the usable curtain louvers is limited to approximately 5 inches. However, desirable are two or multipart curtain systems in which the curtain louvers are more narrow, and in which the latter are closable without any light gap between the parts of the system.

A louver curtain is known from EP-B-0 081 465 of applicant, which has a ball chain as the drive. The aforementioned problems are avoided to a large extent with said louver curtain; however, the comparably high expandability of the ball chain results in known drawbacks, and requires for a motor drive a special device for compensating the expansion.

The invention is based on the problem of creating a louver curtain of the above type which avoids the aforementined problems. The louver curtain is to be functionally reliable even with large and multipart systems, and with a motor drive. The problem is resolved by the invention according to claim 1.

In order to obtain a two-part louver curtain it is sufficient if, in the course of installation, some sliders are turned against the others by 180 degrees. These sliders are then in engagement with the one strand and the other sliders with the strand of the driving element running in the opposite direction. Only one belt guide is required on each of the two sides of the plane of the curtain, and only one single point of connection is needed in the driving element. In this way it is possible to avoid the aforementioned problems when the louvers of the curtain are brought together.

As the driving element is a sprocket chain, the latter can be manufactured substantially free of expansion. This assures even with large systems that the curtain louvers are in each case swivelled parallel with one another.

An important advantage of the louver curtain according to the invention is that the sliding elements can be equipped with a worm drive as basically known from EP-B-0 081 465. Said worm drive permits that with a high reduction ratio of, for example 1:10, even heavy curtain louvers as used, for example for blacking out a room, can be swivelled and displaced. Sliders with a worm drive, however, offer the additional advantage that with a self-locking design, the curtain louvers are safely locked against rotation and stable in any position.

Any unintentional swivelling of the curtain louvers, for example by a gust of wind, is hence prevented.

In addition, a worm drive accommodating on top of it spacing-limiting elements in the rail is known from EP-0 081 465. Thus the spacing-limiting elements can be invisibly accommodated in the rail. Said spacers offer the additional benefit that the louvers can be adjusted in any intermediate position. No locking prior to swivelling is required in this case. The louver curtain according to the invention thus combines the advantages of the generic louver curtain with those of the aforementioned louver curtain having a ball chain as the driving element.

According to another feature of the invention, the sprocket chain is a bridged-string chain. The latter can be manufactured by injection molding at favorable cost, and, furthermore, is significantly more flexible and has lower friction than the apertured belt of the generic louver curtain.

The louver curtain can be manufactured in a particularly simple manner and with functional reliability if, according to another feature of the invention, the teeth are produced by molding on the ends of bridges, and directed against one another. This permits a direct and secure connection of the teeth with the strings.

According to another feature of the invention, the teeth have projections extending crosswise relative to the longitudinal direction. In this way, it is possible to keep the friction surface and thus the frictional resistance very small and low.

Furthermore, if the teeth have depressions at the points of passage of the strings, the flexibility of the driving belt can be increased. With negligible expansion and very low friction, this makes the sprocket chain at the same time very flexible, which in turn has a bearing on the energy consumption.

The sliders can be installed in a particularly simple way if they have a two-part casing, and if the casings are connected with locking means.

A particularly simple structure of the sliding elements is obtained if the joined surfaces of the two parts of the casing has bearing surfaces for the axles of a worm drive. According to another feature of the invention, the parts of the casing have, for said purpose, projections engaging corresponding depressions of the other part of the casing, whereby the depressions and the projections form bearing surfaces. Such a sliding element is particularly stable, and it can be manufactured in a simple way by injection molding. Additional advantageous features are specified in the other claims and in the following specification.

An exemplified embodiment of the louver curtain according to the invention is explained in greater detail in the following on the basis of the drawing, in which.

Figure 1:
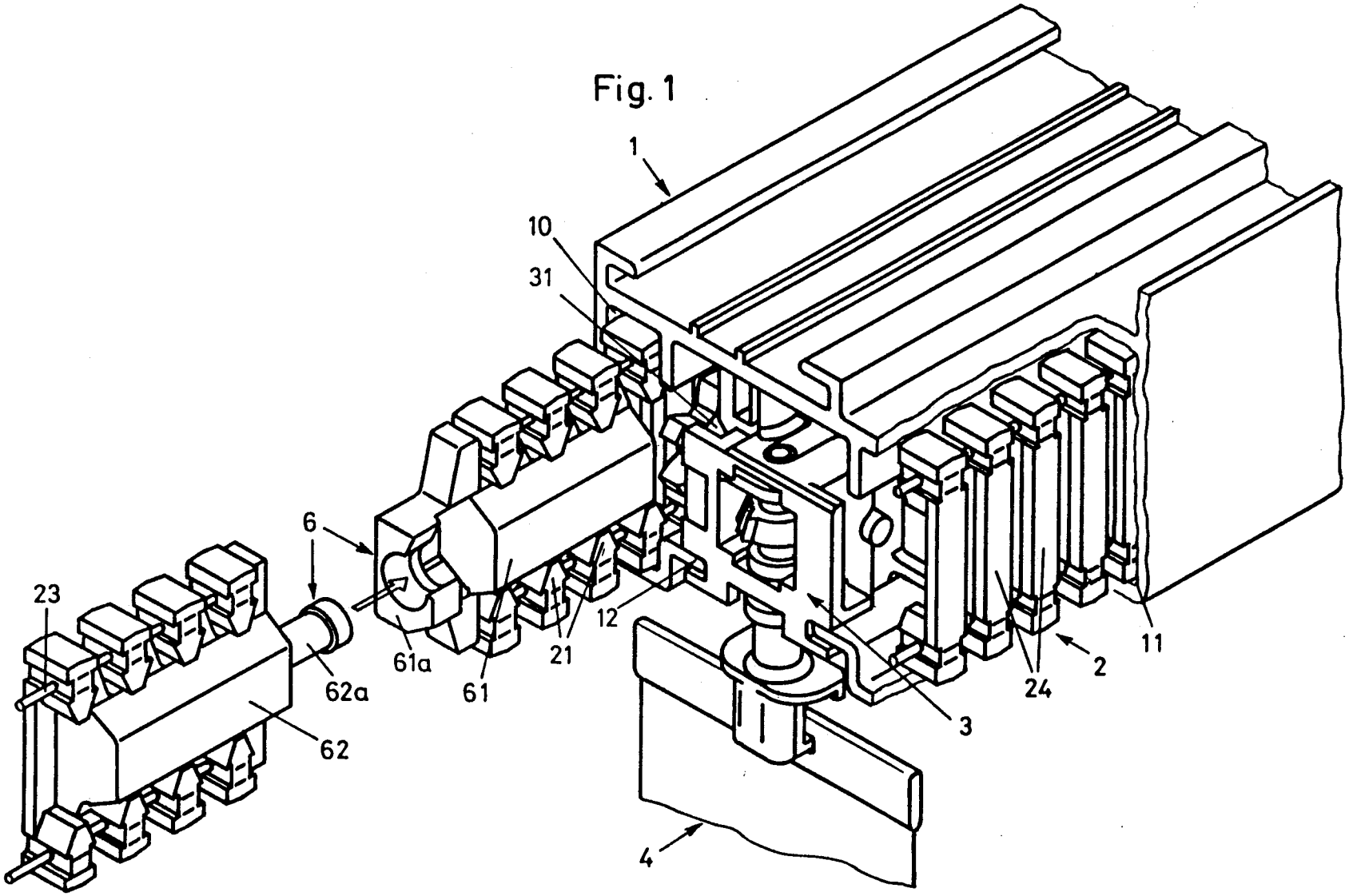
FIG. 1 is a view of a part of a louver curtain according to the invention.

The louver curtain has a curtain rail 1 made of aluminum on the ceiling of a building, in which the sliding elements 3 are displaceably guided in the known way. A curtain louver 4 is detachably fastened on each sliding element 3 in the manner known per se. With a sprocket chain 2 as the driving element, the sliding elements 3 can be displaced in the longitudinal direction of the curtain rail 1 to open or close the curtain, and with the same driving element, the curtain louvers 4 each can swivelled around the axis of a swivel axle 32 in any position of the sliding elements 3. With a two-part belt connector 6, the sprocket chain 2 is connected to form an endless train, which is guided via two reversing pulleys (not shown here) arranged at the ends of the curtain rail 1. Said pulleys are, in the manner known per se, supported in casings, and can be driven by an electric motor (not shown), or by a crank drive. The sprocket chain 2 can be moved in the one or other direction, through which motion the curtain louvers 4 are swivelled in the one or other direction around a vertical axis, or displaced in one of the longitudinal directions of the curtain rail.

With a one-part curtain, all of the sliding elements 3 are connected among one another with the spacing-limiting elements 5. With a two-part or multipart curtain, the sliding elements 3 associated with the one or other part of the curtain are connected among each other. According to FIG. 2, each spacing-limiting element 5 has two spacing-limiting plates 51 and 52, which are fastened in a gap 55 between two arms 53 and 54 molded on a casing part 39. The one spacing plate 52 is displaceable to a limited extent between the arms 53 and 54 in the longitudinal direction, whereas the spacing plate 51 is undisplaceably connected with the casing part 39. For displacing the spacing plate 52, a frictional resistance has to be overcome which is greater than the frictional resistance that has to be overcome for swivelling the curtain louvers 4. Furthermore, said spacing-limiting elements 5 can be embodied as specified in EP-0 081 465.

Figure 2:
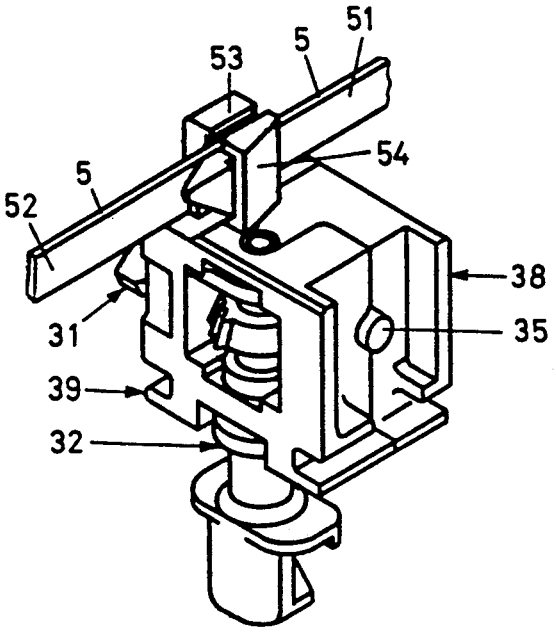
FIG. 2 is a view of a sliding element.
Figure 3:
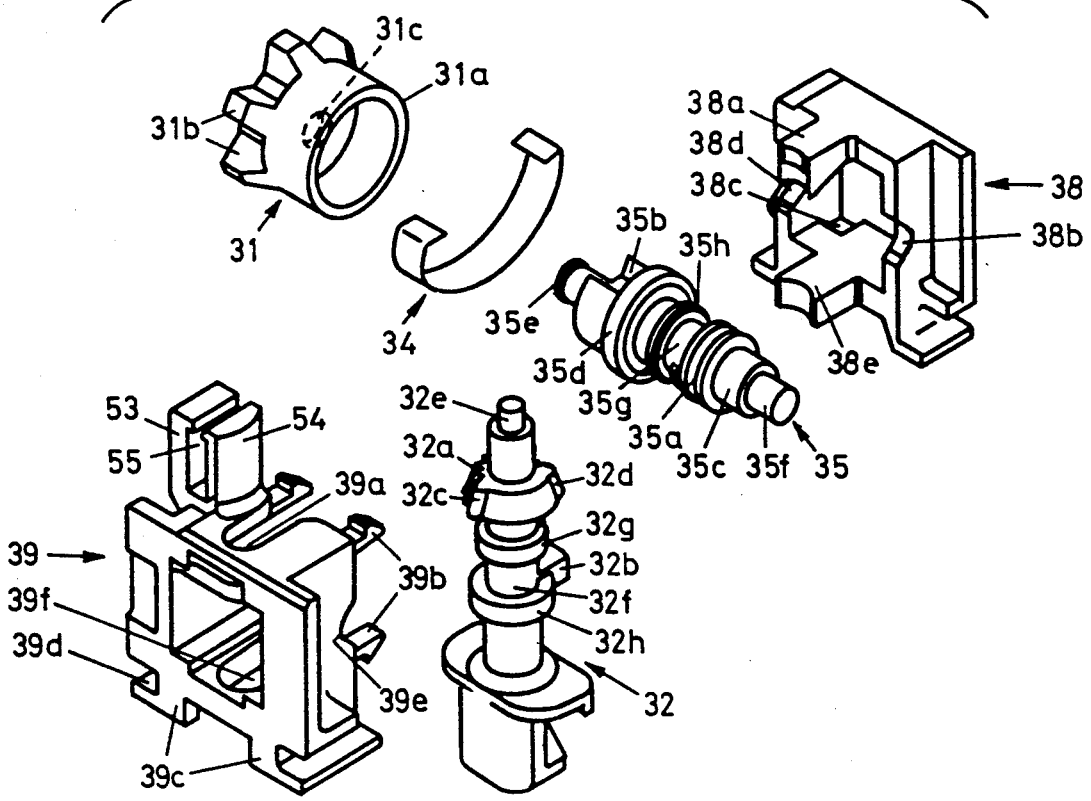
FIG. 3 is a view of a sliding element pulled apart.

FIGS. 2 and 3 show that each sliding element 3 has two casing parts 38 and 39, in which a worm drive with a worm 35 and a worm gear 32 is supported. The worm 35 has on a cylindrical basic body 35*c* a spiral 35*a* of the single-start worm, an annular stop means 35*d*, a holding device 35*b* for a bent flat spring 34, a slipping clutch, as well as a locking thickening 35*e* molded onto the worm. In the assembled condition, the spiral 35*a* is in engagement with the teeth 32*a* of the worm gear 32. The teeth 32*a* extend over only part of the circumference of the worm gear 32, and are limited by the stops 32*c* and 32*d*. Said stops 32*c* and 32*d*, which cooperate with the spiral 35*a*, are arranged in such a way that the worm gear 32 can be swivelled by means of the worm 35 by slightly less than 180 degrees. In addition, a radially projecting stop cam 32*b* is molded onto the worm gear 32, said cam cooperating with the wall parts 39*c* of the casing part 39.

The toothed gear 31 has a through-extending axial opening 31*c*, in which the end of the worm 35 is inserted and locked, said end being fitted with the bead 35*e*. The spring 34 is inserted under radial tension in a sleeve-shaped attachment 31*a* and forms a friction grip connection and a slip clutch between the worm 35 and the toothed gear 31.

The two casing parts 38 and 39 are kept together by the four locking tongues 39*b*, which engage with their front ends a deepening 38*c* of the casing part 38. The deepenings 38*b* and 39*e* form a bearing for a journal pin 35*f* of the worm 35, and a deepening 38*d*, together with a similar deepening on the casing part 39 not visible here, forms a bearing for a bearing surface 35*g*, which is arranged between the two annular stop means 35*d* and 35*h*.

Thus the worm 35 can be rotated with the toothed gear 31, whereby the worm gear 32 can be swivelled within the range delimited by the stop means 32*c* and 32*d*. For its support, the worm gear 32 has, at its upper end, a journal pin 32*e*, which is inserted in a recess 39*a* of the casing part 39, and secured in said recess with a corresponding insert 38*a* of the bearing part 38. A bearing surface 32*f* arranged with a spacing from the latter is seated in a similar recess 39*f*, and is secured therein by an attachment 38*e*. The vertical movement of the worm gear 32 is limited by the two annular attachments 32*g* and 32*h*.

The reduction ratio of the worm drive preferably amounts to about 1:10. This makes the worm drive self-locking. This has the important advantage that the curtain louvers cannot be swivelled unintentionally in any position of swivel.

Figure 4:
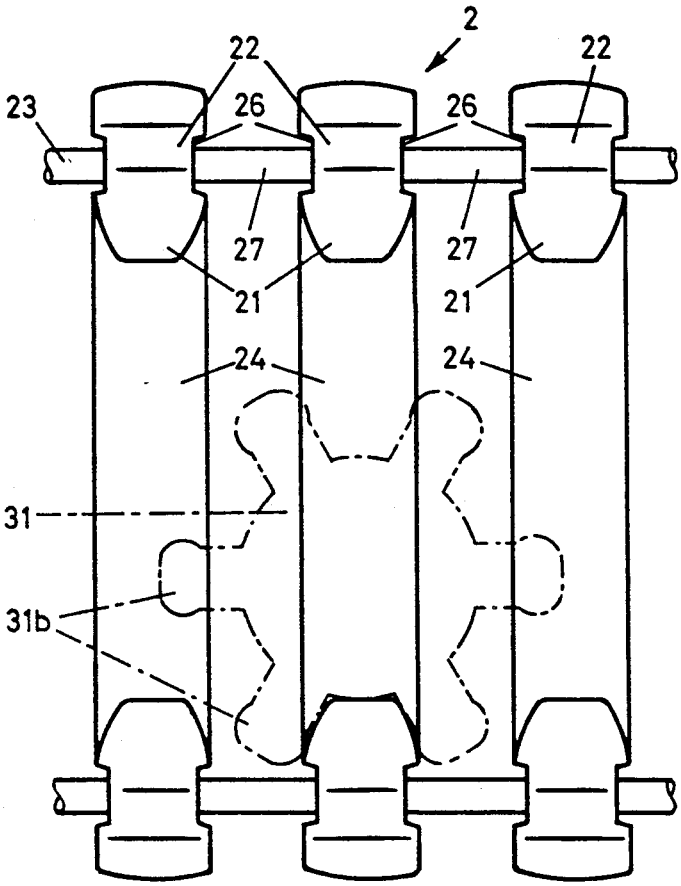
FIG. 4 shows a segment of the sprocket chain and a toothed gear mating therewith.
Figure 5:
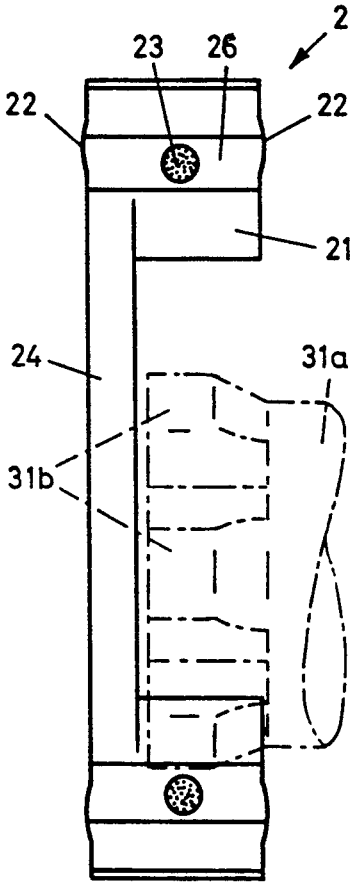
FIG. 5 is the view according to FIG. 4, but seen in the longitudinal direction of the sprocket chain.

The sprocket chain 2, which according to FIGS. 4 and 5 mates with the teeth 31*b* of the toothed gears 31, is the driving element for the sliding elements 3. The sprocket chain 2 has the two parallel stranded steel cords 23, which are arranged with a spacing between one another, and to which the bridges 24 are attached by injection molding. Thus the bridges 24 are rigidly joined with the flexible stranded steel cords 23. Two teeth 21, which are directed against each other, are molded onto each bridge 24, said teeth projecting laterally on the same side, as clearly shown particularly in FIG. 5. Thus the teeth 21 form an upper and a lower row of teeth, whereby the toothed gears 31 mate in this case with the lower row of teeth. Conceivable, too, would be a design in which the toothed gears 31 mate with the upper row of teeth. The teeth 21 are connected with one another by comparatively narrow bridges 25 having a rectangular cross section. Each tooth has in about its center the two projections 22, which form small sliding surfaces. Crosswise thereto, the teeth 21 have the deepenings 26 within the zone of the stranded steel cords 23. In this way, the free zones 27 of the stranded steel cords 23 are made substantially longer than the zones covered by casting, so that the driving element can be embodied with special flexibility.

With a single-part louver curtain, all sliding elements 3 are inserted in the curtain rail 1 in such a way that all toothed gears mate with the same strand of the sprocket chain 2. With a two-part louver curtain, the sliding elements 3 of the one part of the curtain are turned by 180 degrees around the vertical axis the worm gear 32, so that the toothed gears 31 of said sliding elements mate with the strand running back.

The louver curtain is actuated as follows:

When the curtain is open, the curtain louvers 4 are pulled to the side, forming a small package. For closing the curtain, the electric motor is started with a switch, or a manual crank is actuated, so that the segments of the sprocket chain 2 running up and back are displaced in their guide ducts 10 and 11 in the opposite directions. Now, owing to the rotation of the toothed gears 31 caused thereby, the curtain louvers 4 are first swivelled, whereby said motion of swivel is limited by the end position of the worm drive. When the sprocket chain 2 is pulled further, the package of louvers is displaced in the longitudinal direction of the curtain rail 1. Once the last displaceable sliding element has reached the spacing from the end of the rail fixed by the plate 51, it stops. It is then followed by the second-last, etc., etc., until the entire curtain has been pulled apart and the foremost sliding element rests against the other end of the curtain rail. Once a sliding element stops in its predetermined position, its toothed gear 31 engaging the sprocket chain 2 is freewheeling due to the slipping clutch.

When the curtain is pulled back, the curtain louvers 4 are first swivelled in the reverse sequence, and subsequently displaced to the other end of the curtain rail 1 to form the package. As the friction of the toothed gear 31 with the worm 35 is greater than the friction of the plates 32 between the arms 53 and 54, the curtain louvers 4 can be swivelled while the curtain is pulled in any position. This applies to two-part or multipart curtain systems as well.

Thus the sprocket chain 2 is stressed not only with respect to tension but also to pressure. Breaking of the stranded cords 27 due to repeated stressing by pressure can be avoided if the stranded cords are coated with a plastic material, preferably with a polyamide. The thickness of the coating is, for example 0.2 mm.

Figure 6:
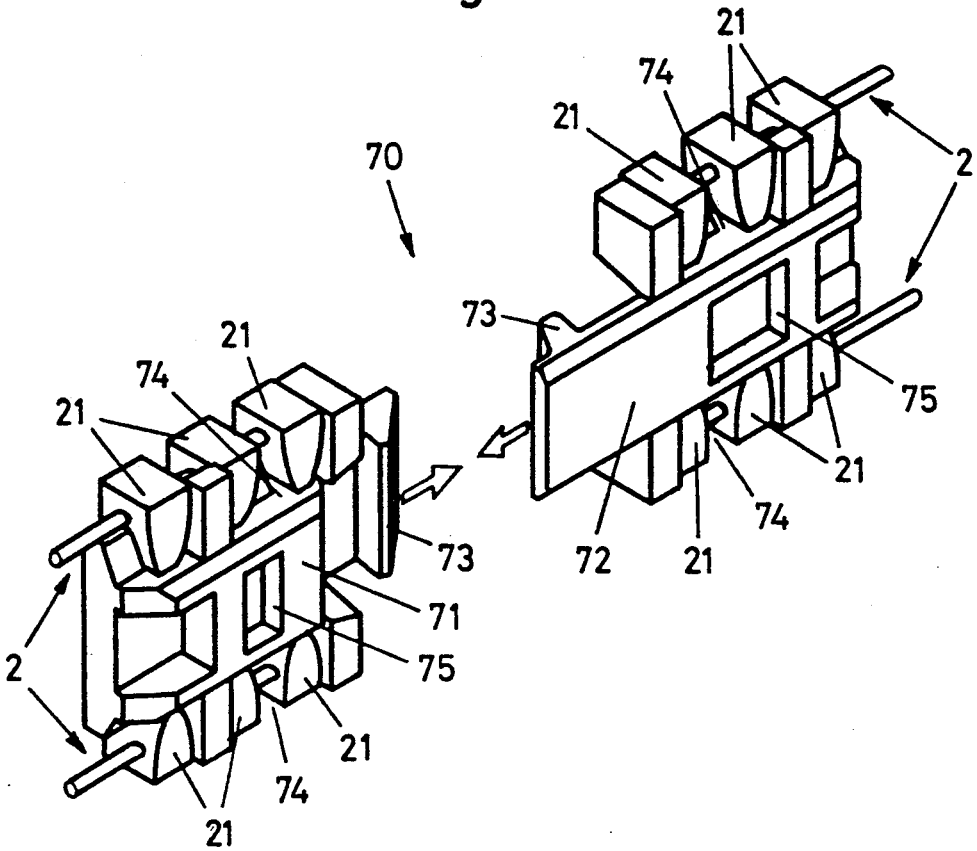
FIG. 6 is a perspective view of a belt connector according to a variation.

FIG. 6 shows a variation of a belt connector 70 consisting of the two similar parts 71 and 72. Each of said parts 71 and 72 has the gaps 74, in which the teeth 21 of three bridges can be detachably inserted in each case, so that the parts 71 are rigidly connected with the sprocket chain 2 in the longitudinal direction of the latter. Each part 71 or 72, furthermore, has a claw 73, as well as the deepenings 75 arranged on the broadside. In order to join the sprocket chain 2 at its ends, the parts 71 and 72 are pushed against one another until the claws 73 locked each other. The parts 71 and 72 are pushed with screwdrivers inserted in the deepenings 75. The belt connector 70 permits a particularly safe and detachable connection of the sprocket chain 2.

I claim:

1. A louver curtain comprising:

a plurality of curtain louvers;

a curtain rail;

a plurality of sliding elements each connected to one of said curtain louvers, and adapted to be slidably guided in said curtain rail;

said sliding elements further comprising a toothed wheel and a horizontal worm, said toothed wheel rotatably engaged with said horizontal worm; and a driving element adapted to be guided in said curtain rail comprising a sprocket chain further comprising a bridged string chain including a plurality of bridges operatively connected by strings, said sprocket chain having teeth, wherein each tooth of said sprocket chain is secured to one end of one of said bridges of said string chain, said teeth of said sprocket chain mating and engaging with said toothed wheel of said sliding elements; wherein movement of said driving element causes the displacing of said sliding elements and the rotation of said worm, thereby displacing and swivelling said curtain louvers.

2. A louver curtain according to claim 1, wherein said teeth of said sprocket chain further include lateral projections forming sliding surfaces that slidably engage with said curtain rail.

3. A louver curtain according to claim 1, wherein each of said sliding element is further comprised of two casing parts joined with one another.

4. A louver curtain according to claim 3, wherein said casing parts have recessed areas and projections disposed opposite one another and adapted for supporting said worm.

5. A louver curtain according to claim 1, wherein said sprocket chain includes teeth arranged on a broadside and projecting laterally.

6. A louver curtain according to claim 1, wherein said toothed wheels of said sliding elements further include a sleeve-shaped member for accommodating a spring or a slip clutch.

7. A louver curtain according to claim 1, wherein said sprocket chain includes plastic coated, resilient stranded cords.

8. A louver curtain according to claim 7, wherein said stranded cords are coated with a polyamide.

9. A louver curtain comprising:

a plurality of curtain louvers;

a curtain rail;

a plurality of sliding elements each connected to one of said curtain louvers, and adapted to be slidably guided in said curtain rail;

said sliding elements further comprising a toothed wheel and a horizontal worm, said toothed wheel rotatably engaged with said horizontal worm; and a driving element adapted to be guided in said curtain rail comprising a sprocket chain further comprising a bridged string chain including a plurality of bridges having apertures for allowing the passage of said strings therethrough, said bridges operatively connected by strings, said sprocket chain having teeth mating and engaging with said toothed wheel of said sliding elements; wherein movement of said driving element causes the displacing of said sliding elements and the rotation of said worm, thereby displacing and swivelling said curtain louvers.

10. A louver curtain comprising;

a plurality of curtain louvers;

a curtain rail;

a plurality of sliding elements each connected to one of said curtain louvers, and adapted to be slidably guided in said curtain rail;

said sliding elements further, comprising a toothed wheel and a horizontal worm, said toothed wheel rotatably engaged with said horizontal worm; wherein said sliding elements of one part of said curtain are disposed 180 degrees relative to said sliding elements of another part of said curtain, and a driving element adapted to be guided in said curtain rail comprising a sprocket chain having teeth mating and engaging with said toothed wheel of said sliding elements; wherein movement of said driving element causes the displacing of said sliding elements and the rotation of said worm, thereby displacing and swivelling said curtain louvers.

* * * * *